US007901152B2

(12) United States Patent
Hines et al.

(10) Patent No.: US 7,901,152 B2
(45) Date of Patent: Mar. 8, 2011

(54) FABRIC CLEANING FLUID AND DISPENSING DEVICE

(75) Inventors: John David Hines, Bebington (GB); Jane Elizabeth Ormond, La Lucia (ZA); Brian Arthur Steinhobel, Gauteng (ZA)

(73) Assignee: The Sun Products Corporation, Wilton, CT (US)

( * ) Notice: Subject to any disclaimer, the term of this patent is extended or adjusted under 35 U.S.C. 154(b) by 704 days.

(21) Appl. No.: 10/579,353

(22) PCT Filed: Oct. 28, 2004

(86) PCT No.: PCT/EP2004/012245

§ 371 (c)(1),
(2), (4) Date: Jan. 25, 2007

(87) PCT Pub. No.: WO2005/046423

PCT Pub. Date: May 26, 2005

(65) Prior Publication Data

US 2007/0274768 A1 Nov. 29, 2007

(30) Foreign Application Priority Data

Nov. 13, 2003 (GB) ..... 0326496.7
Aug. 16, 2004 (GB) ..... 0417227.6

(51) Int. Cl.
*B43K 5/06* (2006.01)

(52) U.S. Cl. ..... 401/174; 401/172; 401/265

(58) Field of Classification Search ..... 401/171–175, 401/78, 261–267
See application file for complete search history.

(56) References Cited

U.S. PATENT DOCUMENTS

| | | | | |
|---|---|---|---|---|
| 2,748,991 | A | 6/1953 | McCarthy | |
| 3,896,822 | A * | 7/1975 | Zimmerman | 15/104.94 |
| 4,074,944 | A | 2/1978 | Xavier | |
| 4,111,567 | A * | 9/1978 | Berghahn et al. | 401/202 |
| 4,155,871 | A | 5/1979 | Donaldson | |
| 5,039,451 | A | 8/1991 | Phillips et al. | |
| 5,071,594 | A | 12/1991 | Borland et al. | |
| 5,075,501 | A | 12/1991 | Borland et al. | |
| 5,100,252 | A | 3/1992 | Podolsky | |
| 5,505,041 | A * | 4/1996 | Harlan | 53/473 |

(Continued)

FOREIGN PATENT DOCUMENTS

BE 337440 11/1926

(Continued)

OTHER PUBLICATIONS

International Search Report.

(Continued)

*Primary Examiner* — David J Walczak
(74) *Attorney, Agent, or Firm* — Sterne, Kessler, Goldstein & Fox P.L.L.C.

(57) ABSTRACT

A dispensing device (1) comprising a reservoir (3) for storing a fabric cleaning fluid (9) having a viscosity of over 10 Pa.s at rest or under an applied stress of up to 10 Pa, one or more dispensing orifices (13) in fluid communication with the reservoir (3), a movable platform movable (11) by means of a screw mechanism (19), whereby rotation of a screw (21) advances the movable platform (11) against the stored, fabric cleaning fluid (9) thereby dispensing a metered dose of the cleaning fluid (9) from the reservoir (3) to be dispensed via the dispensing orifices (13).

22 Claims, 3 Drawing Sheets

U.S. PATENT DOCUMENTS

| | | | | |
|---|---|---|---|---|
| 5,653,338 | A * | 8/1997 | Tani | 206/385 |
| 5,697,531 | A * | 12/1997 | Fattori | 222/390 |
| 6,231,259 | B1 * | 5/2001 | Murgida et al. | 401/175 |
| 6,336,763 | B1 * | 1/2002 | Losier et al. | 401/205 |
| 2003/0008799 | A1 | 1/2003 | Barnabas | |
| 2007/0277850 | A1 | 12/2007 | Ormond et al. | |

FOREIGN PATENT DOCUMENTS

| | | | |
|---|---|---|---|
| BE | 353297 | | 8/1928 |
| CH | 275977 | | 6/1951 |
| DE | 1073997 | | 1/1960 |
| DE | 20301533 | U1 | 5/2003 |
| EP | 0092363 | | 10/1983 |
| FR | 669.856 | | 2/1929 |
| FR | 1227 461 | | 8/1960 |
| FR | 2770109 | | 4/1999 |
| GB | 384083 | | 12/1932 |
| GB | 2179054 | | 2/1987 |
| GB | 2 205 486 | A | 12/1988 |
| WO | WO 95/05440 | | 2/1995 |
| WO | WO 97/12027 | * | 4/1997 |
| WO | 2005/046422 | A1 | 5/2005 |

OTHER PUBLICATIONS

Search Report for GB 384,083, dated Feb. 25, 2004 (1 page).

Office Action issued for U.S. Appl. No. 10/579,267, mailed on Oct. 2, 2009 (10 pages).

International Search Report for PCT/EP2004/012244, European Patent Office, mailed Mar. 4, 2005 (3 pages).

* cited by examiner

FABRIC CLEANING FLUID AND DISPENSING DEVICE

The present invention relates general to a dispensing device dispensing a fabric cleaning fluid having a high viscosity i.e. a viscosity over 10 Pa.s at rest or under an applied stress of up to 10 Pa.

It is an object of the present invention to provide an improved dispensing device for dispensing fabric cleaning fluids having a viscosity over 10 Pa.s at rest or under an applied stress of up to 10 Pa.

According to the present invention, there is provided a dispensing device comprising:

(a) a reservoir for storing a fabric cleaning fluid having a viscosity over 10 Pa.s at rest or under an applied stress of up to 10 Pa;

(b) one or more dispensing orifices in fluid communication with the reservoir;

(c) a movable platform movable by means of a screw mechanism, whereby rotation of a screw advances the movable platform against the stored fabric cleaning fluid thereby dispensing a metered dose of the cleaning fluid from the reservoir to be dispensed via the dispensing orifices.

All viscosity values and ranges referred to herein are measured at 25 degrees celcius.

An advantage of a screw mechanism is that the quantity of fluid delivered is controlled by the screw feed ie. it is directly proportional to the amount by which the screw is rotated and not dependent on the viscosity of the fluid. This is in contrast with eg. pump dispensing devices. Hence even very high viscosity fluids e.g. pastes can be dispensed accurately using the invention.

The fabric cleaning fluid may be a non-newtonian, shear-thinning liquid having viscosity profile such that from rest and up to an applied shear stress of 10 Pa the viscosity of the fluid is at least 100 Pa.s and under a shear field of 20 $s^{-1}$ of at most 5 Pa.s. The viscosity of the fluid may be at least 300 Pa.s or may be at least 500 or at least 1000 or at least 10,000 under a shear field of 20 $s^{-1}$ of at most 5 Pa.s.

The dosing accuracy is not compromised by shear-thinning properties which some cleaning solutions exhibit. Shear thinning gel-type detergent compositions are desirable for a number of reasons. For example they are generally suitable for stable suspending particles therein, since they usually have adequate viscosity when in rest or under very low shear. On the other hand, owing to their shear thinning properties, such gel-type compositions have much lower viscosity when under increased shear.

The pitch of the screw is preferably constant so that the amount of fluid dispensed per turn of the screw remains throughout use constant.

The term "fluid" herein is intended to include a liquid, gel, and paste e.g. pastes formed from a solid cleaning product e.g. cleaning/detergent powder, granules, flakes, tablets (which may be crushed) ,pellets together with a solvent, e.g. water.

The device may further comprise a scrubbing member for scrubbing the fabric.

With this arrangement the device can be used as a hand wash or pretreatment device, eg. prior to a main wash process as in an automatic washing machine. The device may be a hand held device which hold a limited number of doses, e.g. 1 to 10 of the fluid, so that it is refilled from a larger consumer pack.

One advantage of using such high viscosity fluids within such a device is that they are less likely to leak when the device is set down after use. So that is does not necessarily require storage an upright position or with a closure device to prevent leakage.

Preferably, the external surface of the scubber member is abrasive. To this end the scrubbing member may comprise a coarse mesh structure. Alternatively or additionally, the scubbing member may comprise one or projections, such as finger-like 'villi' or ribs. The scrubbing member may be formed from a rigid material, so that if a mesh or projections are stiff to provide effective scrubbing. However, for delicate fabrics, more flexible scrubbing materials can be used. The scrubbing member may comprise a plurality of scrubbing surfaces to offer the user a choice. In this way a varied washing load (with both delicate and more harder wearing fabrics) can be treated without the need for multiple tools.

The movable platform may comprise a side wall or base wall of the reservoir, whereby moving e.g. sliding the platform within the reservoir, progressively decreases the reservoir volume which compresses the cleaning composition thereby forcing it to exit the reservoir via the dispensing orifice/s.

The screw mechanism may comprise at least two threaded shafts one fixed to the platform and one fixed to part of the device constrained to prevent any movement with the platform. The shafts may engage upon rotation to move the platform relative to the reservoir.

The screw mechanism may be telescopic so that an externally threaded shaft engages with an internally threaded shaft.

The device preferably includes an actuator, which allows the user to actuate the screw mechanism and therefore move the platform up and down within the reservoir.

The actuator may be attached to one of the threaded shafts, and may form a base portion of the device.

The scrubbing member may be in fluid communication with the dispensing orifices, such that as the cleaning fluid exits the reservoir it is exposed on the exterior surface of the scrubbing member.

The scrubbing member may be positioned adjacent the dispensing orifice/s, externally of the reservoir such that there is a gap there between which can be filled with fluid. The scrubbing member may form a cage like structure which envelopes a portion of the reservoir, including the orifice/s.

The scrubbing member may include an orifice or orifices to allow the dispensed fluid to reach the external abrasive surface. The orifice(s) of the scrubber may be provided by a material having a mesh structure e.g., the apertures of the mesh providing multiple dispensing orifices. The mesh may be abrasive to provide a scrubbing surface.

The reservoir is preferably fillable and refillable with cleaning fluid or components thereof (e.g. detergent powder and water) by the user. To this end, the reservoir preferably has a removable (e.g. by a screw fitting or snap-fit arrangement) portion to allow access. This may be a cap which may be attached to the scrubbing means, such that both are removed to fill/refill the reservoir with cleaning fluid. Alternatively the scrubbing member alone may be the removable portion.

The device may comprise a tubular body including a tubular reservoir axially aligned with a elongate screw member. The platform may be configured for reciprocal movement so that under release of the force i.e. by opposite turn of the screw the platform moves in a reverse direction. This can be used to relieve residual stress in the fabric cleaning fluid (for interim storage purposes).

Preferably the platform has a peripheral edge which is configured to slide in a sealing relationship with an inner surface of the reservoir, whereby sliding is guided by said inner surface. The peripheral edge may be flexible to provide such a sealing relationship.

With this arrangement, the device can be used both to store and dispense cleaning fluid with minimal or no leakage via the moving platform.

The device may be shaped e.g. the exterior surface may have one or more recesses or indentations for ergonomic purposes, to ease the handling and gripping of the device during use.

In addition, according to a second aspect of the invention there is provided a method of dispensing a fabric cleaning fluid having a viscosity over 500 Pa.s. using the device according to the first aspect of the invention (and optional features as described above).

the method comprising the steps of:

(a) filling the reservoir with the fluid, optionally obtained by mixing a solid cleaning composition e.g. powder, granules, and a solvent e.g. water to form a cleaning fluid having a viscosity over 500 Pa.s within the reservoir, (b) securing a removable portion e.g. end cap and scrubbing member on the device to close the reservoir (c) moving the platform e.g by rotating the screw mechanism dispense to force a metered dose of the cleaning fluid from the reservoir.

The device may incorporate a scubbing member in which case the dispensed fluid may be exposed on the exterior of the scrubbing means and the fabric cleaned by scrubbing with said scubbing means.

The device of the invention may be supplied as a commercial package including (a) a cleaning fluid and/or (b) a cleaning solid for mixing with a solvent to prepare a cleaning fluid having a viscosity of over 10 Pa.s at rest or under an applied stress of up to 10 Pa.

(c) instructions to direct the user to use the package according to the method of the second aspect of the invention.

Exemplary Formulations for the Cleaning Fluid

| | Wt % | |
|---|---|---|
| Component: | A | B |
| Propylene glycol | 8.0 | 8.0 |
| sodium citrate | 3.9 | 3.9 |
| Borax | 3.0 | 3.0 |
| NaOH (50%) | 1.1 | 1.1 |
| Monoethanolamine | 1.0 | 1.0 |
| LAS-acid | 4.4 | 4.4 |
| Coconut fatty acid | 1.5 | 1.5 |
| Nonionic surfactant | 11.1 | 11.1 |
| Oleic acid | 2.3 | 2.3 |
| 1-Dodecanol | 5.0 | 0.0 |
| Protease enzyme | 0.3 | 0.3 |
| Lipase enzyme | 0.5 | 0.5 |
| Perfume | 0.2 | 0.2 |
| Water | balance to 100 | balance to 100 |

wherein:

Borax : Sodium tetraborate (10 aq)

nonionic surfactant: ethoxylated alcohol with on average 9 ethylene oxide groups.

The gel detergent composition exemplified by composition A was found to be shear thinning and stable. Typical detergent particles of density between 0.8 and 0.9 g/cm3 and having a diameter up to 5000 microns could be stable suspended in this composition for more than 2 weeks without any observable net movement of the particles.

The non-gelled comparative detergent composition exemplified by composition B differed from composition A only in the absence of the fatty alcohol (i.e. 1-dodecanol). Composition B was found to be a clear, stable, Newtonian isotropic liquid. Critical Theological properties of the two are given below

| | Viscosity/Pa · s | | Eta 0 | Critical Stress Tan Delta | |
|---|---|---|---|---|---|
| Sample | 20 s − 1 | 100 s − 1 | Pa · s | Pa | at 1 Hz |
| A | 2.11 | 0.61 | 3.00E+05 | 15 | 0.04 |
| B | 0.88 | 0.86 | 0.89 | 0.001 | 57 |

Example 2

| | Wt % | |
|---|---|---|
| Component: | C | D |
| Propylene glycol | 4.75 | 4.75 |
| sodium citrate | 2.8 | 2.8 |
| Borax | 2.3 | 2.3 |
| NaOH (50%) | 0.43 | 0.43 |
| Monoethanolamine | 0.23 | 0.23 |
| LAS-acid | 6.0 | 6.0 |
| Coconut fatty acid | 0.77 | 0.77 |
| Sodium alcohol EO sulphate | 10.5 | 10.5 |
| Nonionic surfactant | 6.6 | 6.6 |
| 1-Decanol | 6.0 | 0.0 |
| Protease enzyme | 0.45 | 0.45 |
| Lipase enzyme | 0.25 | 0.25 |
| Perfume | 0.2 | 0.2 |
| Water | balance to 100 | balance to 100 |

wherein:

Borax : Sodium tetraborate (10 aq)

nonionic surfactant: ethoxylated alcohol with on average 9 ethylene oxide groups Sodium alcohol EO sulphate: ethoxylated alcohol sulphate with on average 3 ethylene oxide groups.

As in example 1, the two compositions, C and D, shown above differ only in that composition C contains 6% fatty alcohol (1-Decanol) and composition D does not. Composition C was found to be a stable, transparent, pourable shear thinning gel while composition D was found to be a stable, clear, Newtonian isotropic liquid. Composition C was found to be capable of stable suspending typical detergent particles having a density of between 0.8 and 0.9 g/cm3 and a diameter of up to 5000 microns, for more than 2 weeks without any observable net movement of the particles.

Critical Theological parameters for the two compositions are shown below.

| | Viscosity/Pa · s | | Eta 0 | Critical Stress Tan Delta | |
|---|---|---|---|---|---|
| Sample | 2Os − 1 | 100 s − 1 | Pa · s | Pa | at 1 Hz |
| C | 1.33 | 0.48 | 9.85E+05 | 10 | 0.07 |
| D | 0.29 | 0.29 | 0.29 | 0.001 | 57 |

For clarification of the Theological values shown in this table, reference is made to the description concerning the similar table shown in above example 1.

Critical Rheological Properties of the Two are Given Below

| | Viscosity/Pa · s | | Eta 0 | Critical Stress Tan Delta | |
|---|---|---|---|---|---|
| Sample | 2Os − 1 | 100 s − 1 | Pa · s | Pa | at 1 Hz |
| A | 2.11 | 0.61 | 3.00E+05 | 15 | 0.04 |
| B | 0.88 | 0.86 | 0.89 | 0.001 | 57 |

For obtaining the values shown in the above theological properties tables, all rheological measurements were carried out at 25° C. using a Carrimed CSL100 rheometer with a cone and plate geometry specially roughed to prevent slip.

Viscosity was measured at varying shear rates from very low shear up to a shear regime in excess of 100 $s^{-1}$. Two situations are shown: the viscosity measured at relatively low shear (20 $s^{-1}$) and that measured at much higher shear (100 $s^{-1}$). It can be seen that the viscosity of composition A at high shear is much lower than that obtained at low shear, whereas composition B shows almost equal viscosity's for high and low shear. In other words compositions A and C is clearly shear thinning, whereas compositions B and D is not.

In addition, the critical stress is shown. This parameter represents the stress at which the material leaves the upper Newtonian plateau and thins under increasing shear. Also, "Eta 0"-values are shown, referring to the viscosity calculated for zero shear from creep flow measurements. Finally, "Tan delta" values are shown, referring to the ratio of loss over storage moduli (G"/G') and reflecting the dominance of viscous over elastic properties such that materials giving very low "Tan delta"-values (tending to zero, such as compositions A and C, will be much more elastic than those giving higher "Tan delta" values (tending to 90).

Various non-limiting embodiments of the invention will now be more particularly described with reference to the following figures in which.

Figure 3:
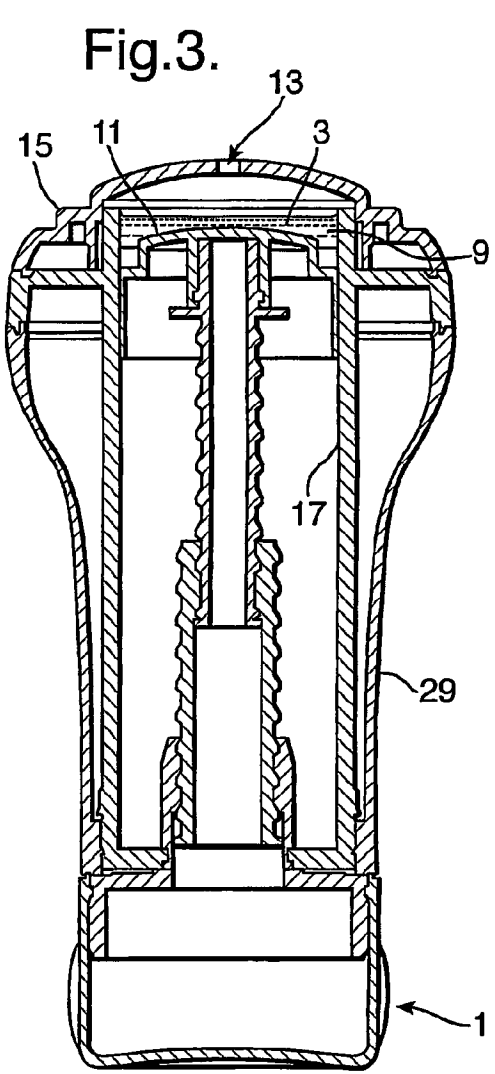
FIG. 3 is a side sectional view of the embodiment shown in FIG. 1, with the platform in a fully raised position.

Common reference numerals are used in all figures to identify features common to all embodiments.

Figure 2:
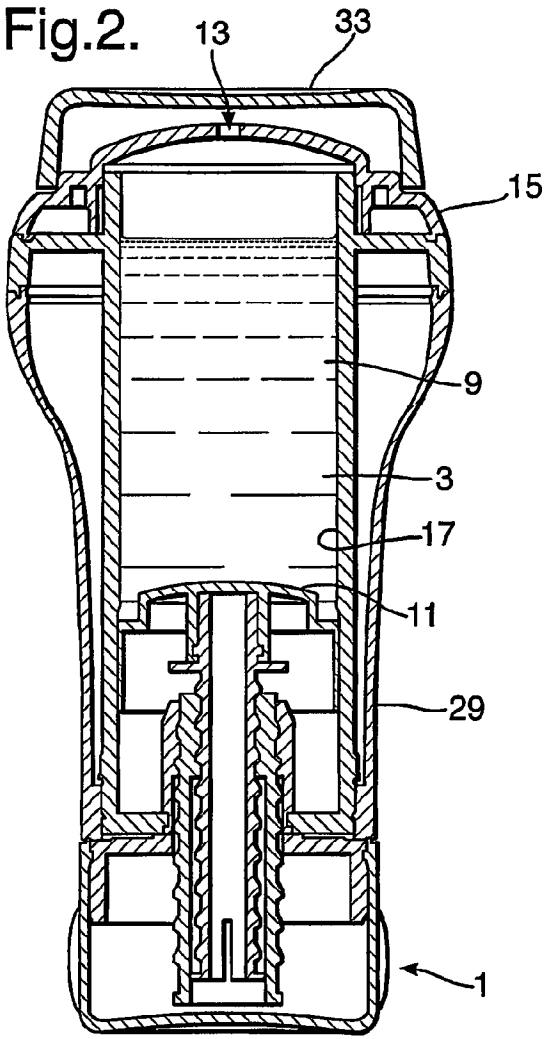
FIG. 2 is a side sectional view of the embodiment shown in FIG. 1 , with the platform in a fully lowered position.
Figure 1:
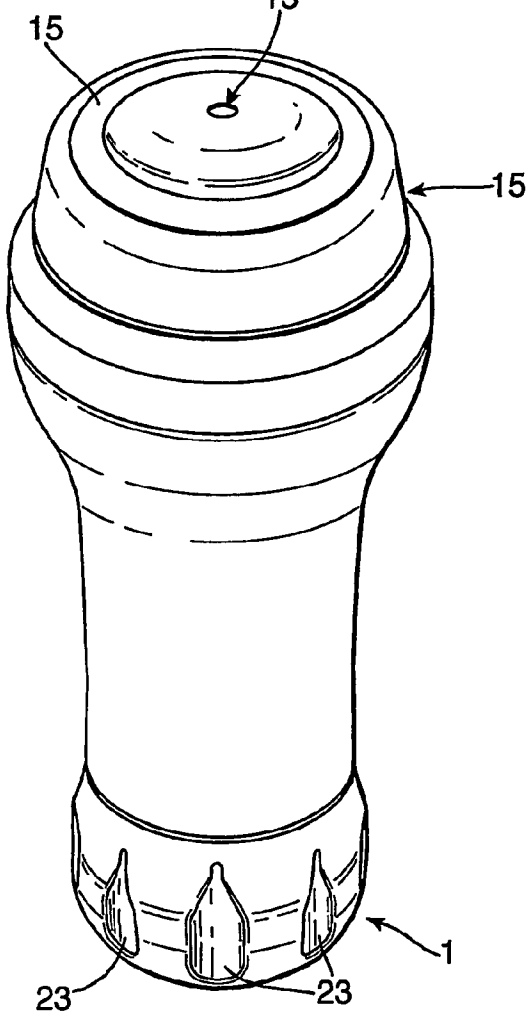
FIG. 1 is a perspective view of one embodiment according to one aspect of the invention.

Referring to FIGS. 1-3, there is illustrated a fabric cleaning fluid dispensing device 1 comprising:

(a) A reservoir 3 located with a housing 29, the reservoir 3 for storing the fabric cleaning fluid 9 having a viscosity of greater than 500 Pa.s.

Figure 4:
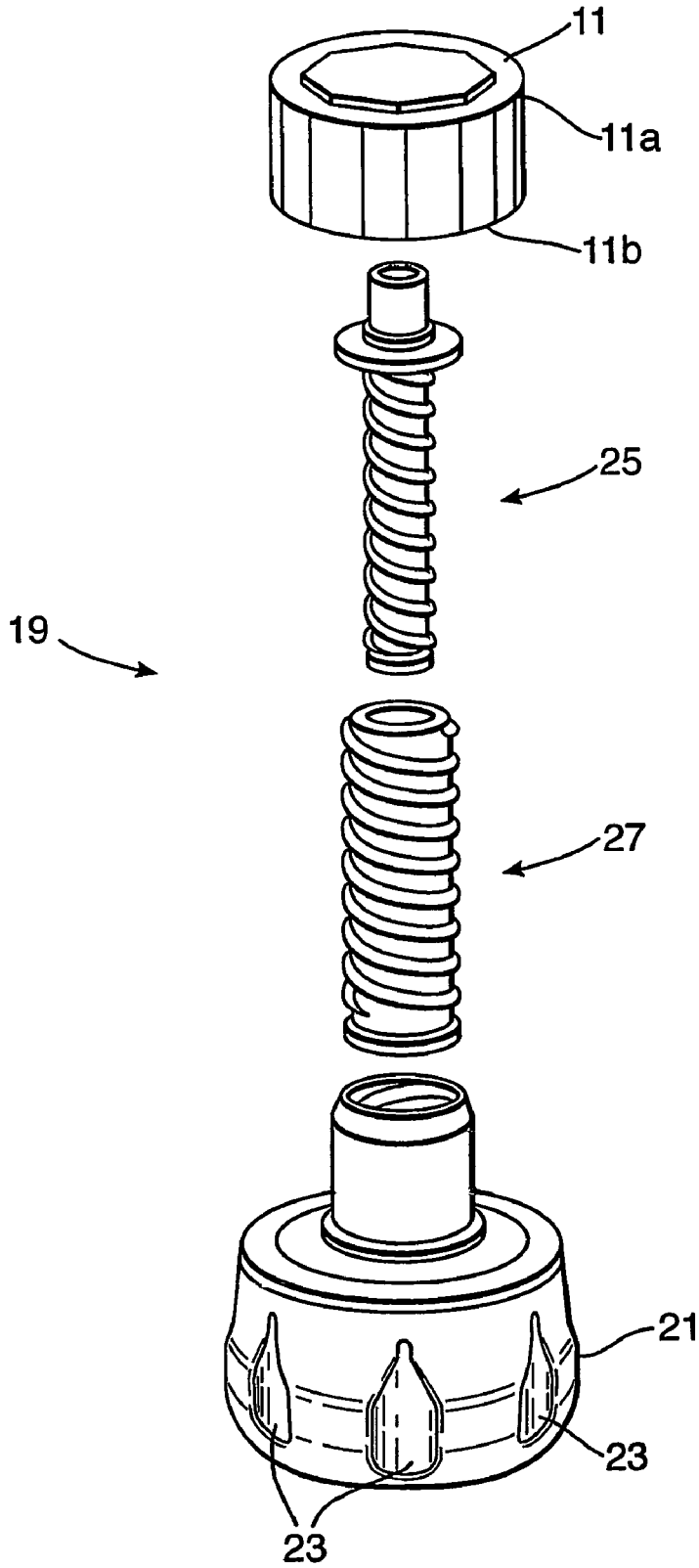
FIG. 4 is a enlarged and exploded perspective view of the screw feed mechanism of FIG. 1.

(b) a dispensing orifice B in fluid communication with the reservoir 3;

(c) a movable platform 11 moveable by means of a screw mechanism 19 (shown in detail in FIG. 4).

The movable platform 11 is generally hexagonal (in plan view) and forms the base portion of the reservoir 3, which is also hexagonal in cross section. In this way the platform 11 cannot rotate relative to the reservoir. Thus sliding the platform 11 axially upwards within the reservoir 3, progressively reduces the reservoir volume.

The reservoir 3 is refillable with the fabric cleaning fluid 9 or components thereof (e.g. detergent powder and water) by the user. To this end, the reservoir has a removable, watertight, screw-fitting (not shown) end piece 15 made from HDPE (high density polyethylene). The end piece 15 can be removed to refill/mix the reservoir with fabric cleaning fluid 3 and then re-secured. The removable end piece 15 forms the roof of the reservoir. The dispensing orifice 13 is located centrally of the end cap 15.

The housing 29 has a head portion 29*a* which has an enlarged diameter which improves handling.

The platform 11 is configured for precise reciprocal axial movement within the reservoir 3.

Axial movement of the platform is effected by a worm drive screw mechanism 19 (shown more clearly in FIG. 4). This comprises a two-piece shaft 25, 27 and actuator 21. The two sections of the shaft are screwed together by respective internal and external threads on shafts 27 and 25. Shaft 25 is fixed to underside 11*b* of the platform 11. Shaft 27 is fixed to actuator 21 by a screw fastened in an opposite direction from that joining shafts 25 and 27. Turning the screw actuator 21 in one direction advances the platform 11 a set distance upward within the reservoir. In this way the reservoir volume is decreased and the fluid forced to exit via the dispensing orifices.

The cleaning fluid 9 can therefore be dispensed in a controlled manner. The screw mechanism does not protrude into the reservoir, for sealing purposes.

By unscrewing the mechanism 19 the platform 11 can slidably move in a reverse direction to relieve any residual stress in the fabric cleaning fluid 9.

The platform has a peripheral edge 11*a* which buts against the inner surface 17 so that it slides in a sealing relationship with the inner surface 17. With this arrangement, the device can be used both to store and dispense cleaning fluid with minimal or no leakage via the moving platform.

The screw actuator 21 is fixed to the base 31 of the device such that both rotate together as a single unit relative to the housing 29 (and reservoir 3).

The external surface of the base has an annular band of recesses and protrusions 23 for ergonomic purposes, to ease the handling and especially to allow for improved gripping of the base during rotation (ie. for dispensing purposes) which is advantageous especially if the device gets wet.

In use the reservoir is filled with cleaning fluid, optionally optained by mixing a solid cleaning composition e.g. powder, granules, and a solvent e.g. water to form a cleaning fluid or paste within the reservoir. The end piece 15 is then screwed on tightly to the device to close the reservoir. The platform 11 is advanced from a lowered state (FIG. 2) towards a raised state (FIG. 3) by turning a screw-feed mechanism 19 to force the cleaning fluid 9 from the reservoir 3 to egress via orifice 13 in a controlled manner.

There may be visual eg. indicating the number of turns of the base per unit dose indicia on the reservoir having dosing quantities to assist the user. Alternatively or additionally the user can dispense the fluid into a machine drawer, shuttle etc according to dose instruction thereon.

The device further includes a cap 33 which snap-fits to the top of the housing as a further measure preventing leakage between use. (Cap only shown in FIG. 2).

Figure 6:
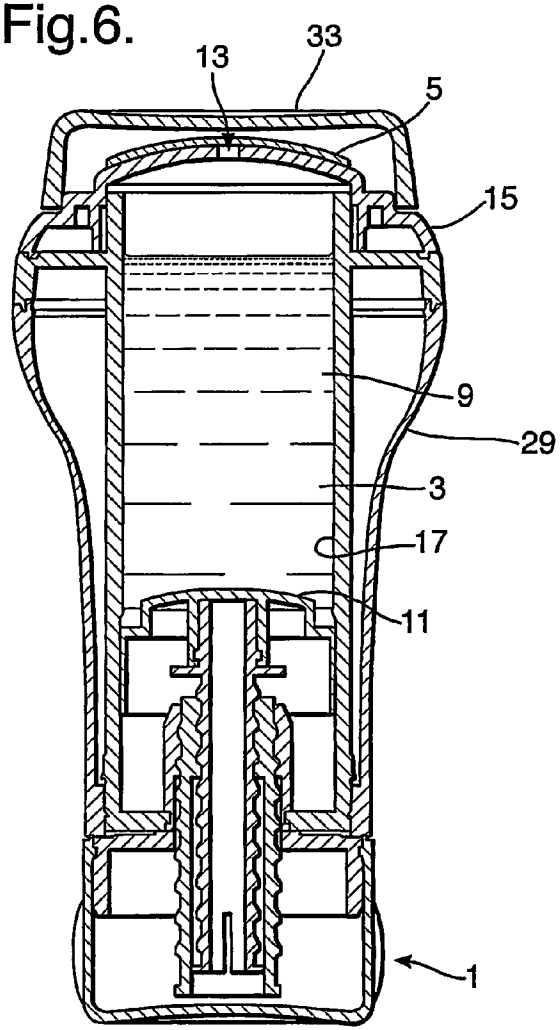
FIG. 6 is a side sectional view of the embodiment shown in FIG. 5.
Figure 5:
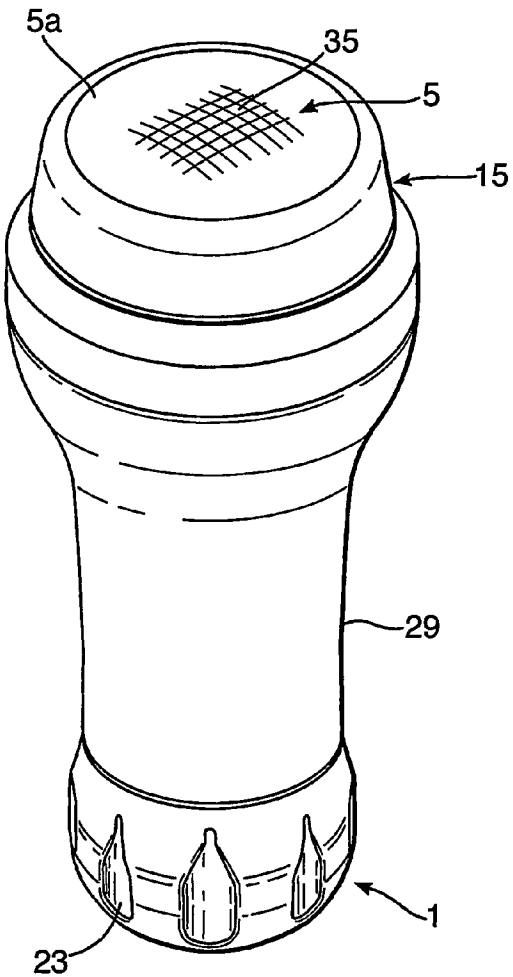
FIG. 5 is a perspective view of a second embodiment according to one aspect of the invention.

The second embodiment shown in FIGS. 5 and 6 is constructed according to the above description except in that it also includes a scubbing member 5 which is fixed over the top wall of the reservoir and forms a cage like structure adjacent the dispensing orifice 13. The scrubbing member 5 comprises a coarse, rigid HDPE (high density polyethylene) mesh, the apertures of which provide orifices 35 through which the fluid passes.

In use, the cleaning fluid is dispensed as described for the first embodiment. The dispensed fluid passes from the orifice 13 to the scrubbing member orifices (shown schematically and referenced 35) to be exposed on the external surface of the scubbing member for cleaning purposes.

Dosage advice and instructions may be provided as per the first embodiment.

It is of course to be understood that the invention is not intended to be restricted to the details of the above embodiments which are described by way of example only.

The invention claimed is:

1. A dispensing device comprising:

a reservoir containing a fabric cleaning fluid, one or more dispensing orifices in fluid communication with the reservoir, and a movable platform movable by means of a screw mechanism, wherein the screw mechanism comprises a first threaded shaft having internal threads, and a second threaded shaft having external threads configured to engage the internal threads of the first threaded shaft, wherein the second threaded shaft is fixed to the movable platform, wherein rotation of the screw mechanism axially advances the movable platform against the stored fabric cleaning fluid thereby dispensing a metered dose of the fabric cleaning fluid from the reservoir, wherein the second threaded shaft is configured to rotate without rotating the movable platform and is configured to move in an axial direction with the axial advancement of the movable platform, and wherein the reservoir and the movable platform are non-circular in cross section to resist rotation of the platform relative to the reservoir.

2. A device according to claim 1 wherein the platform comprises a wall or base portion of the reservoir and sliding the platform within the reservoir progressively reduces the volume of the reservoir thereby forcing the fluid to exit the reservoir.

3. A device according to claim 1 in which the cross section of the reservoir and platform include at least one non-curved section.

4. A device according to claim 1 in which the reservoir is uniform in cross section at least along the length in which the platform moves.

5. A device according to claim 1 in which the platform is configured for reciprocal generally axial movement internally of the reservoir.

6. A device according to claim 1 further comprising an actuator for actuating the screw mechanism, wherein the actuator forms a base portion of the device.

7. A device according to claim 1 wherein the platform comprises a flexible peripheral edge configured to slide in a sealing relationship with an inner surface of the reservoir.

8. A device according to claim 1 further comprising a scrubbing member fixed over a top wall of the reservoir adjacent the one or more dispensing orifices.

9. A device according to claim 8, wherein the scrubbing member comprises a coarse mesh structure formed of high density polyethylene.

10. A device according to claim 9, wherein the apertures of the mesh provide multiple dispensing orifices.

11. A device according to claim 1, wherein the reservoir further comprises a removable end piece that forms a top of the reservoir, the one or more orifices being located in the end piece.

12. A device according to claim 1, further comprising a screw actuator for rotating the screw mechanism, wherein the actuator includes a third threaded shaft having internal threads.

13. A device according to claim 12, wherein the first threaded shaft has external threads configured to engage with the internal threads of the third threaded shaft.

14. A device according to claim 13, wherein the screw actuator is fixed to a base portion of the device, and wherein the screw actuator and the base portion rotate together as a single unit relative to the reservoir.

15. A device according to claim 13, wherein the screw actuator is configured to be turned in a first direction to advance the movable platform a set distance upward within the reservoir, and wherein the screw actuator is configured to be turned in a second direction that is opposite to the first direction to retract the movable platform.

16. A device according to claim 15, wherein rotation of the screw actuator in the first direction rotates and advances the first threaded shaft, whereby the first threaded shaft rotates and advances the second threaded shaft, and whereby the second threaded shaft advances the movable platform.

17. A device according to claim 1, wherein the fabric cleaning fluid is a shear-thinning fabric cleaning fluid having a viscosity profile such that from rest and up to an applied shear stress of 10 Pa the viscosity of the fluid is at least 100 Pa·s and under a shear field of 20 $s^{-1}$ of at most 5 Pa·s.

18. A dispensing device comprising:

a reservoir containing a fabric cleaning fluid, one or more dispensing orifices in fluid communication with the reservoir, and a movable platform movable by means of a screw mechanism, wherein the screw mechanism comprises a first threaded shaft and a second threaded shaft connected together, wherein the second threaded shaft is fixed to the movable platform, wherein rotation of the screw mechanism axially advances the movable platform within the reservoir, the movable platform advancing against the stored fabric cleaning fluid thereby dispensing a metered dose of the cleaning fluid from the reservoir, wherein neither the first nor second threaded shafts extend through the movable platform into the reservoir, and wherein the second threaded shaft is configured to rotate without rotating the movable platform and is configured to move in an axial direction with the axial advancement of the movable platform.

19. A device according to claim 18, wherein the reservoir and the movable platform are non-circular in cross section to resist rotation of the platform relative to the reservoir.

20. A device according to claim 18, wherein the fabric cleaning fluid is a shear-thinning fabric cleaning fluid having a viscosity profile such that from rest and up to an applied shear stress of 10 Pa the viscosity of the fluid is at least 100 Pa·s and under a shear field of 20 $s^{-1}$ of at most 5 Pa·s.

21. A device according to claim 18, wherein the second threaded shaft has a distal end portion and a proximal end portion opposite the distal end, wherein the proximal end portion engages with the first threaded shaft, and wherein the distal end portion contacts a bottom surface of the movable platform.

22. A device according to claim 1, wherein the second threaded shaft has a distal end portion and a proximal end portion opposite the distal end, wherein the proximal end portion engages with the first threaded shaft, and wherein the distal end portion contacts a bottom surface of the movable platform.

* * * * *